United States Patent [19]

Simmons

[11] 4,148,417

[45] Apr. 10, 1979

[54] FLUID DISPENSER

[76] Inventor: Michael J. Simmons, 2757 Tremainsville, Toledo, Ohio 43613

[21] Appl. No.: 745,698

[22] Filed: Nov. 29, 1976

[51] Int. Cl.[2] ..... B65D 35/22

[52] U.S. Cl. ..... 222/94

[58] Field of Search ..... 222/94, 545, 562, 541

[56] References Cited

U.S. PATENT DOCUMENTS

| | | | |
|---|---|---|---|
| 2,907,489 | 10/1959 | Taylor | 222/541 X |
| 3,239,105 | 3/1966 | Woodson | 222/94 |
| 3,380,632 | 4/1968 | Wilson | 222/94 |
| 3,467,269 | 9/1969 | Newton | 222/94 X |
| 3,581,940 | 6/1971 | Cella | 222/94 |
| 3,655,102 | 4/1972 | Moran | 222/562 X |
| 3,729,553 | 4/1973 | Gold et al. | 222/94 X |

FOREIGN PATENT DOCUMENTS

| | | | |
|---|---|---|---|
| 1103534 | 2/1968 | United Kingdom | 222/94 |
| 1448291 | 9/1976 | United Kingdom | 222/94 |

*Primary Examiner*—Joseph F. Peters, Jr.
*Assistant Examiner*—Norman L. Stack, Jr.

[57] ABSTRACT

A convenient squeeze dispenser package for fluids of economical construction featuring a principal body formed of easily molded plastic material configurated into plural compartments and having an exterior contour promoting, enhancing and improving the squeeze dispensement function.

2 Claims, 2 Drawing Figures

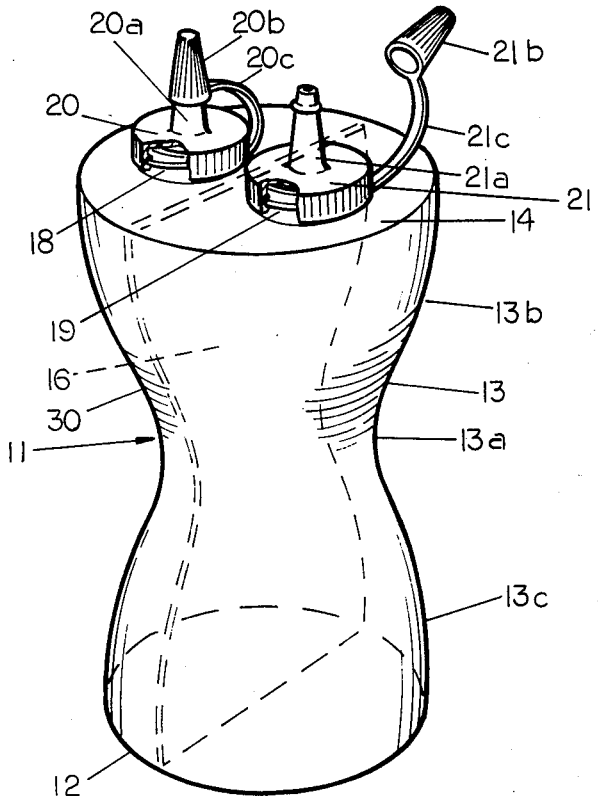

FLUID DISPENSER

The present invention relates to a convenience package of utility for the containment of viscous fluids such as catsup, mustard, honey, salad dressing, mayonnaise, specialty dressings and/or the like. Squeeze bottle constructions for such substances or items are known in the art. Plastic materials such as polyethylenes and vinyls, including vinyl chlorides, have been employed because of their relatively low cost and ease of moldability into a variety of utilitarian and decorative configurations. Primarily, these have been molded to form a single interior void to provide a package for one such comestible item as described above. The principally available dispensing packages on the market are generally cylindrical of contour or of downwardly flaring configuration, requiring a considerable compressive force by the user to expel the contained product and particularly the terminal one-half of the total initial contents.

It is an object of the present invention to provide a convenience dispenser package which features plural compartments and an exterior contour as enhances the expelling of the terminal portion of the comestible product; the latter being accomplished by a decrease in the amount of squeezing force necessary.

The foregoing as well as other objects of the present invention will become apparent to those skilled in the art from the following detailed description taken in conjunction with the annexed sheet of drawings on which there are presented, for purpose of illustration only, several embodiments of the present invention.

Considered most basically, the present invention contemplates a plural compartment container formed of a flexible, moldable material and having an overall exterior wall configuration which lends itself to the impression thereon of opposed compressive forces, as by thumb and opposed fingers, as will maximize the expelling of product therein.

Figure 1:
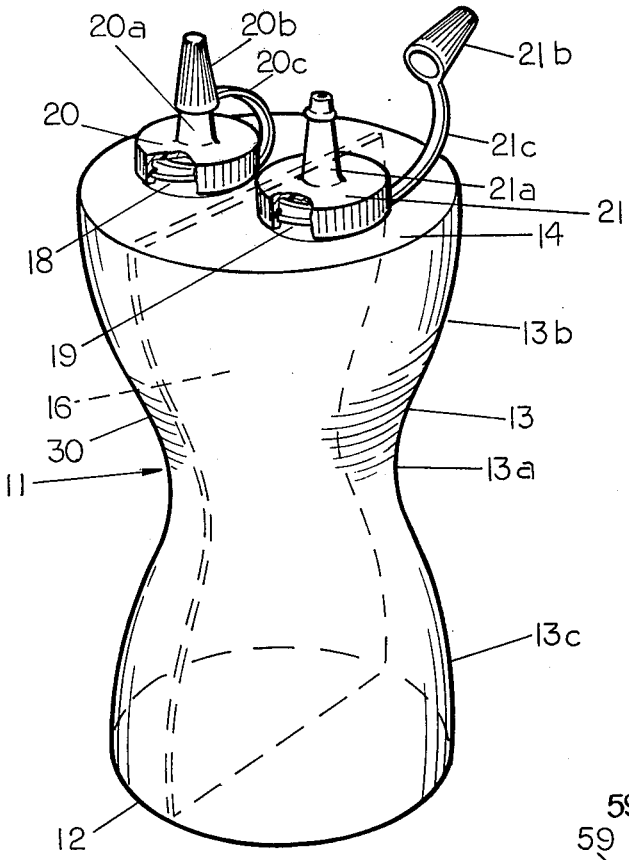
FIG. 1 is a three-quarter perspective view of a dispensing container in accordance with one embodiment of the present invention.

Referring now more specifically to the drawings, in FIG. 1, there is shown a container 11 having a bottom wall 12, a principal surrounding annular wall 13 and a top wall 14; all cooperating to provide a defined interior. Reference numeral 16 identifies a central partition wall or web which divides the container into approximate equal halves, each defining a separate compartment which is adapted to contain individual amounts of viscous product separated from each other. The top wall 14 of the container in the embodiment of FIG. 1 includes a pair of upstanding exteriorly threaded necks or mouths 18 and 19 which are integrally a part of the container as molded. A pair of dispensing fitments 20 and 21 feature a matchingly threaded lower skirt which engages the threaded necks 18 and 19 and each also include a central vertical upstanding hollow nipple-like nozzle 20*a* and 21*a*, terminating in a minor dispensing orifice. Closure caps 20*b* and 21*b* are molded simultaneously with the corresponding dispensing fitment and connected to the fitment by a convenience strip connector 20*c* and 21*c*. The closure caps are adapted to telescope onto the nozzles. Both the nozzles 20*a*–21*a* and the closures 20*b*–21*b* feature small, interior, annular ribs which provide a snap releasable engagement for a secure closure and at the same time readily snap removal.

The container is formed of any of the conventional plastics such as the polyvinyl resins, polyester materials, polyethylene materials, polycarbonate materials and the selection of a particular molding material forms no particular part of the present invention. The molding may be performed in multi-cavity molds and employing metal inserts or plugs to form the voids. The metal inserts or plugs are desirably segmented, that is, composed of a plurality of components shiftable from a void-defining configuration to a configuration, shape and size as is removable from the mouth.

The interior may also, more desirably, be formed by the employment of a fluid such as air or other gas coupled with extrusion of the formable plastic. Extrusion and pneumatics are combined in what is commonly referred to as the "blow molding" technique of forming hollow containers. This technique can also be used to form the double compartment featuring a central web or partition. Instead of extruding a simple cylinder, however, a tubular extrudate is formed having two side by side apertures and resembling, in section, a modified figure 8. Such an extrudate would require dual orifice pneumatic gripping heads for the blowing and extrusion.

It is an important feature of the present invention, as to the embodiment of FIG. 1, that the annular wall 13 feature a central necked-in region 13*a* to thereby define an enlarged upper half 13*b* and lower enlarged half 13*c*. The exterior surface of the container located between the necked-in region 13*a* and upper enlarged region 13*b* is particularly accommodative and suited for effective compression between the thumb and fingers of the user. A compressive force applied to this region (see reference numeral 30) is most effectively translated into an effective compressive expelling of the viscous product from the particular unclosured dispensing orifice. With both dispensing cap closures off, the opposed compressive force, applied in region 30, can be applied at different radial positions to achieve proportioning of the dispensed viscous fluid in accordance with the proportion of individual fluid desired by the user according to his wishes, tastes or the like.

Figure 2:
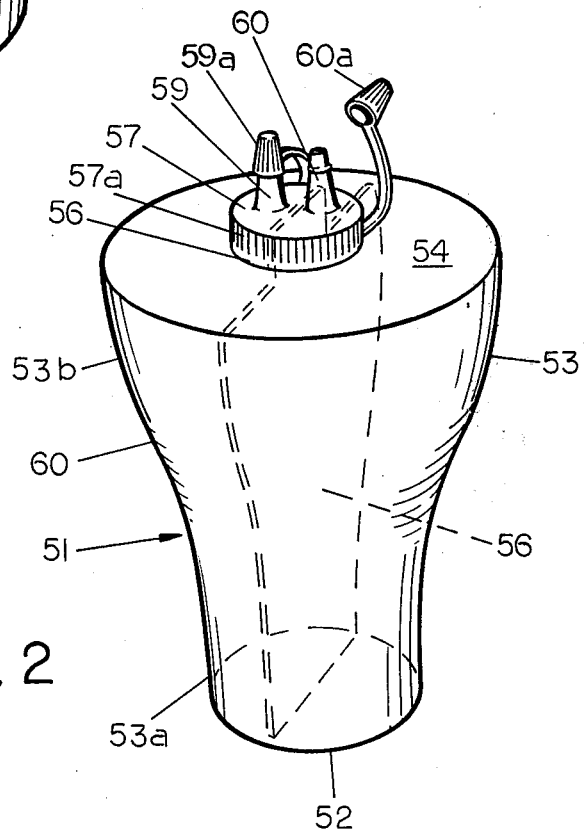
FIG. 2 is a similar view of a further embodiment of the present invention.

Referring now more particularly to the embodiment of FIG. 2, the container identified by the reference numeral 51 includes a bottom wall 52, a principal surrounding annular wall 53 and a top wall 54; all cooperating to provide an interior divided by central partition wall or web 56 into approximately equal halves, which independently define a separate void adapted to contain separate independent viscous products separated from each other. The top wall 54 includes an upstanding, exteriorly-threaded neck or mouth 56, which is integrally a part of the container as molded. A single dispensing fitment 57 features an integral depending skirt 57*a*, which contains interior matching threads to those on the neck 56, allowing rotational engagement of the fitment onto the threaded neck. In this embodiment, the central wall extends, as shown, up into the neck region sufficiently to abut the fitment and maintain the separation of the two compartment halves. The fitment 57 in the embodiment of FIG. 2, includes a pair of integral, hollow, vertically upstanding nozzles 59 and 60 which allow for discharge of the particular fluid contained in the particular void in registry therewith, depending upon the orientation of the dispensing fitment. Closure caps 59*a* and 60*a* are identical in construction to the closure caps described in the embodiment of FIG. 1, and are, like the latter, connected by webs to the fitment proper as determined by the mold cavity in the molds employed in forming such fitments and closure caps.

In the embodiment of FIG. 2, the exterior wall surface defines a lower segment or region identified by the reference numeral 53*a*, which is smaller in diameter or circumference than the somewhat enlarged upper region identified by the reference numeral 53*b*. This embodiment, like the one of FIG. 1, features, in view of the foregoing structural configuration, a region identified by the reference numeral 60, which is most accommodative of a compressive force which is translatable into maximum expelling of the viscous product of the unclosured nozzle. With both closures removed, and being in close proximity on either side of the partition or web 56, the compressive pressure may be applied from different opposing radial directions to achieve a proportioning, in amount, of the particular fluid or viscous comestible product within the individual compartments, all in accordance with desirable objectives and aims of the structure of the present invention.

In accordance with the further embodiment of the present invention, two separate containers, each having the configuration of one-half of that identified by reference numeral 51, are molded, each featuring a complementary flat side wall corresponding in general to the configuration of the inner wall to web or partition 56. These individual containers each feature one-half of an upstanding neck. In accordance with this embodiment, the two halves are assembled with their planar surfaces in registry and secured to each other by a suitable adhesive. The neck halves on each would form a complete neck for encirclement and threading engagement by a fitment, such as an appropriately designed fitment 57. Alternatively, each half can feature its own neck as in the embodiment of FIG. 1.

The preferred contour, configuration or shape of the wall of the container of the present invention, as illustrated in the drawings and described hereinabove, provides for enhanced discharge of product. This enhancement of dispensement or discharge is due to the fact that compression of the divergingly angular flexible wall by the user, in which the thumb and opposed index and adjacent finger compress the wall at zones approximately 180 degrees apart, results in an increase in a moment of force which is coincident with or parallel with the axes of the upstanding dispensement nozzles. As a consequence, a given compressive pressure results in an increased amount of dispensed product. Similarly, a lesser pressure is needed to achieve dispensement of the same amount of product as would be achieved with a greater pressure compressively exerted on an outer wall contour which is essentially cylindrical. With a cylindrical structure, of course, the wall is parallel to the axis of the dispensement orifice and consequently the compressive force would be more nearly perpendicular to the nozzle axis of dispensement.

Accordingly, the dispensing container of the present invention contemplates a manually compressible wall contour which, in its non-compressed state, is angularly disposed with respect to the axes of the dispensing nozzles, preferably at regions 180 degrees disposed from each other, and, furthermore, said angularity proceeding divergingly toward the top wall and the upstanding dispensing nozzle openings.

In accordance with the further embodiment of the present invention, the independently molded containers having the flat complementary wall surface are located flushly together and held in registry while a heat shrinkable, transparent plastic wrap is wound or placed about the assembly, followed by a subjection of the assembly to heat, irradiation or other stimulation as to effect a heat sealing and desirably shrinking of the wrap material to thereby hold the independent containers in firm, oriented registry so that they operate, in concert, as a single container.

Instead of sheet material, the outer wrap can be a preformed annular structure capable of telescopically receiving the two separate containers and holding them snugly together to simulate a singular container. The preformed annular band can also be formed of a thin foam-like material to lend insulating character and, at the same time, provide for flexibility in imparting an informational label or accommodating the availability of trade names and other printed information independently of the formation of the blow molded, injection molded or compression molded container bodies.

Many variations and modifications of the structures, concepts and principles enunciated hereinabove will be apparent to those readers generally knowledgeable in the art and accordingly all such obvious variants, modifications, additions and subtractions are intended to be covered by the appended claims unless such changes, additions, subtractions and departures from the above would be violative of the language of said appended claims.

I claim:

1. A squeeze dispenser for flowable product comprising a hollow container defined by a (generally annular body wall of circular cross-section and formed of flexible material, a connected transverse bottom wall, at least one connected interior partition wall dividing said container into a plurality of compartments, a connected top wall, said top wall including integral upstanding nozzles constructed and arranged with discharge orifices for dispensement of flowable product from said separate compartments responsive to opposed compression forces on said body wall, said body wall featuring a circular contour (upon which) uniformally converging in a direction away from said top wall, so that opposed, normally-applied, compression forces exert an increased moment of force or pressure parallel with the axis of discharge of said nozzle openings, said moment of pressure being exerted on flowable product to enhance dispensement or discharge of said product.

2. A squeeze dispenser for flowable product comprising an elongate structure having two side-by-side compartments extending generally the length of such structure, a removable closure at one end having two dispensing nozzles in respective registry with said compartments, and wherein said elongate structure includes an outer wall surface contour (constructed and arranged) which is convergent in a direction leading away from said nozzles such that (normally-applied), opposed, compression forces (on) applied normal to said contour exert an increased moment of force or pressure parallel with the axis of discharge of said nozzle openings (.) and improves the discharge of flowable product from said dispensing nozzles.

* * * * *